US008834110B2

(12) United States Patent
Gafner et al.

(10) Patent No.: US 8,834,110 B2
(45) Date of Patent: Sep. 16, 2014

(54) STEAM TURBINE CASING SYSTEM

(75) Inventors: Silvia Gafner, Teufenthal (CH); Ludwig Boxheimer, Rieden (CH)

(73) Assignee: Alstom Technology Ltd, Baden (CH)

( * ) Notice: Subject to any disclaimer, the term of this patent is extended or adjusted under 35 U.S.C. 154(b) by 797 days.

(21) Appl. No.: 12/914,176

(22) Filed: Oct. 28, 2010

(65) Prior Publication Data

US 2011/0097201 A1 Apr. 28, 2011

(30) Foreign Application Priority Data

Oct. 28, 2009 (IT) ..... MI2009A001872

(51) Int. Cl.
*F01D 25/26* (2006.01)

(52) U.S. Cl.
CPC ..... *F01D 25/26* (2013.01); *F05D 2220/31* (2013.01)
USPC ..... 415/200; 415/214.1

(58) Field of Classification Search
USPC ..... 415/200, 213.1, 214.1, 134, 138, 139, 415/220
See application file for complete search history.

(56) References Cited

U.S. PATENT DOCUMENTS

| | | | | |
|---|---|---|---|---|
| 1,352,278 | A * | 9/1920 | Junggren | 415/135 |
| 2,247,423 | A * | 7/1941 | Webster, Jr | 415/209.2 |
| 3,861,827 | A * | 1/1975 | Peabody et al. | 415/209.2 |
| 3,892,497 | A * | 7/1975 | Gunderlock et al. | 415/134 |
| 4,032,253 | A | 6/1977 | Ryncosky et al. | |
| 4,112,582 | A | 9/1978 | Beckershoff | |
| 4,204,803 | A * | 5/1980 | Leger et al. | 415/209.2 |
| 4,534,700 | A * | 8/1985 | Horler et al. | 415/135 |
| 6,171,053 | B1 * | 1/2001 | Ulma | 415/178 |
| 6,189,413 | B1 | 2/2001 | Morse et al. | |
| 6,302,644 | B1 | 10/2001 | Kukalj et al. | |
| 6,325,596 | B1 * | 12/2001 | Tomko | 415/209.2 |
| 6,352,405 | B1 | 3/2002 | Tomko | |
| 7,581,922 | B1 | 9/2009 | Morimoto et al. | |
| 2005/0232759 | A1 | 10/2005 | Bailleul et al. | |
| 2008/0317591 | A1 * | 12/2008 | Golinkin et al. | 415/213.1 |
| 2010/0209234 | A1 | 8/2010 | Dallinger et al. | |

FOREIGN PATENT DOCUMENTS

| | | |
|---|---|---|
| CA | 2 478 623 A2 | 11/2004 |
| CH | 241064 | 6/1943 |
| DE | 1 005 531 | 4/1957 |
| DE | 3506538 A1 | 8/1986 |

(Continued)

OTHER PUBLICATIONS

German Search Report dated Feb. 13, 2012, issued by German Patent Office in corresponding German Patent Application No. 10 2010 048 812.7 (5 pages).

(Continued)

*Primary Examiner* — Edward Look
*Assistant Examiner* — Aaron R Eastman
(74) *Attorney, Agent, or Firm* — Buchanan Ingersoll & Rooney PC

(57) ABSTRACT

The disclosure relates to a steam turbine outer casing that can be at least partially cast out of a first material and has a plurality of support regions adapted to support an inner casing. The outer casing can be at least one support region that has a metal insert, made of a second material, with a flaring portion for retaining the metal insert in the casting of the outer casing. The second material has a greater hot strength than the first material. The support region can include a guide for limiting the movement of the inner casing in the outer casing.

20 Claims, 3 Drawing Sheets

(56) References Cited

FOREIGN PATENT DOCUMENTS

| | | | |
|---|---|---|---|
| EP | 1026369 | A1 | 8/2000 |
| EP | 1180581 | A2 | 2/2002 |
| EP | 1586394 | A1 | 10/2005 |
| EP | 2022951 | A1 | 2/2009 |
| GB | 243 974 | | 12/1925 |
| GB | 369680 | A | 3/1932 |
| JP | S52-18512 | | 2/1977 |
| JP | 59-7204 | U | 1/1984 |
| JP | 2002-115502 | A | 4/2002 |
| JP | 2005-171783 | A | 6/2005 |
| JP | 2006-316749 | A | 11/2006 |

OTHER PUBLICATIONS

*Italian Search Report issued on Jun. 23, 2010, for Italian Application No. MI20091872.
*Written Opinion, for Italian Application No. MI20091872.
Office Action (First Office Action) issued on Jan. 30, 2014, by the Chinese Patent Office in corresponding Chinese Patent Application No. 201010539267.X, and an English Translation of the Office Action. (9 pages).
An English Translation of the Office Action (Notification of Reasons for Refusal) issued on Mar. 17, 2014, by the Japanese Patent Office in corresponding Japanese Patent Application No. 2010-241306. (2 pages).

* cited by examiner

STEAM TURBINE CASING SYSTEM

RELATED APPLICATIONS

This application claims priority under 35 U.S.C. §119 to Italian Patent Application No. MI2009A001872 filed in Italy on Oct. 28, 2009, the entire content of which is hereby incorporated by reference in its entirety.

FIELD

The disclosure relates to axial flow steam turbine casings and to temperature resilient support regions that form part of steam turbine outer casings.

BACKGROUND INFORMATION

A known high temperature steam turbine can include an outer casing and an inner casing. The outer casing can be made of a material with relatively low hot strength, which is easy to cast. The inner casing can be made of a material with a higher hot strength so that it can withstand higher temperature. One of the functions of an outer casing is to provide axial, circumferential, and/or radial support of the inner casing, by configured support regions. As there is a wide range of known inner casing designs there is also a wide range of support region configurations, each adapted for specific inner casing configurations. In each case, at least some support regions provide axial and/or circumferential support.

Near the inlet region of the steam turbine, support contact points of the inner casing can reach temperatures above the safe operating limit of low hot strength materials that may be used to cast the outer casing. While it is known to provide localised heat protection by means of inserts, as for example disclosed in EP 1,586,394 A1, such inserts can have a number of deficiencies. For example, when exposed to loads applied to support regions, inserts can have an increased tendency to separate from the casting. As a result, inserts can be unsuitable for use as support regions.

A known solution used to address the problem of localised heating at support regions of the outer casing is to cast the whole outer casing from a material with higher hot strength. This can result in a more difficult casting with higher rejection rates, thus increasing manufacturing costs.

SUMMARY

A steam turbine casing system, is disclosed including an outer casing including, a casting made of a first material, and a support region; and an inner casing, enclosed by the outer casing, for enclosing a rotor, the inner casing including a contact surface in contact with the support region, wherein the support region includes a metal insert, made of a second material with a greater hot strength than the first material, that has an encased surface encased in the casting, wherein the encased surface includes, relative to the radial outward direction (ROD), a flaring portion that flares at least one of axially and circumferentially, a support surface, in contact with the contact surface, configured in conjunction with the contact surface to maintain a separation between the inner casing and the casting; and a guide for guiding the contact surface over the support surface.

BRIEF DESCRIPTION OF THE DRAWINGS

Exemplary embodiments of the present disclosure are described more fully hereinafter with reference to the accompanying drawings, in which.

Figure 1A:
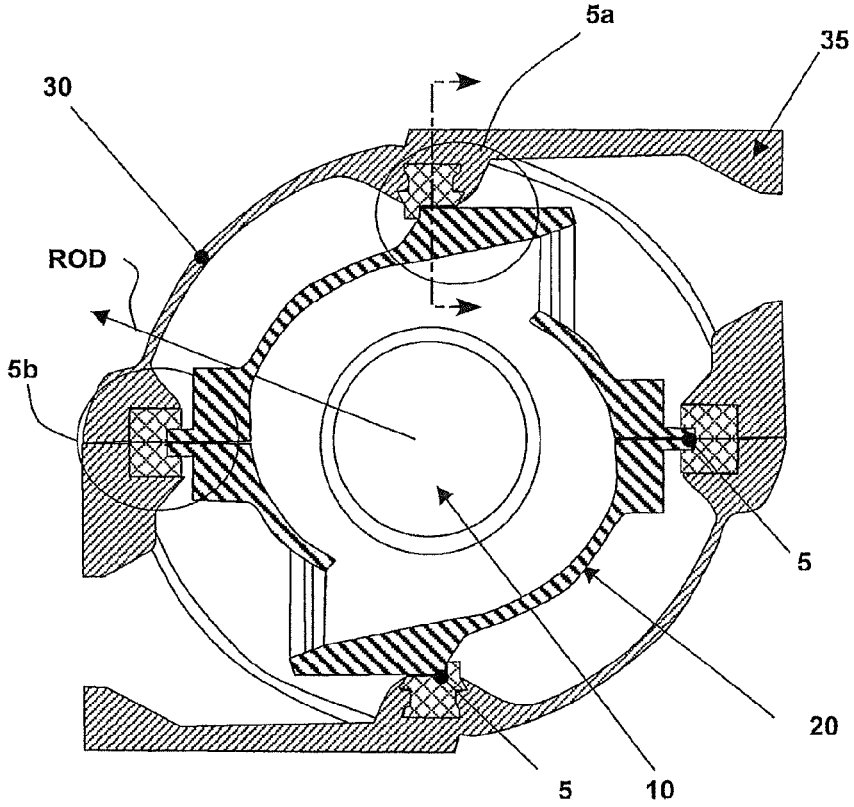
FIG. 1*a* is a cross sectional view of an exemplary steam turbine showing outer and inner casings that include an exemplary support system.

Exemplary embodiments of the present disclosure will be described with reference to the drawings, wherein like reference numerals are used to refer to like elements throughout. In the following description, for purposes of explanation, numerous specific details are set forth in order to provide a thorough understanding of the disclosure. It may be evident to the ordinarily skilled artisan that the disclosure may be practiced without these specific details.

DETAILED DESCRIPTION

A steam turbine casing system is disclosed herein that can address localised heating of inner casing support regions and/or address an insert design that render inserts unsuitable for use as hot inner casing support regions.

An exemplary steam turbine casing system includes an outer casing that encloses an inner casing that itself further encloses a rotor. The outer casing has a casting, made of a first material, which includes a support region. The inner casing has a contact surface that is in contact with the support region. The support region includes a metal insert that is made of a second material that has a greater hot strength than the first material and so can withstand hotter temperatures than the casting. The metal insert includes an encased surface that is encased in the casting. This encased surface includes, relative to the radial outward direction, an axially and/or circumferentially flaring portion which fixes the metal insert in the casting and can prevent "loosening" of the metal insert to enable it to withstand applied loads that can include, for example, lateral loads. The metal insert can also includes a support surface, in contact with the contact surface, that can be configured, in conjunction with the contact surface, to maintain a separation between the inner casing and the casting. This separation can provide a means to prevent overheating of the casting. The metal insert can further include a guide means adapted to guide the contact surface over the support surface while enabling relative movement of the inner casing and the outer casing. Such relative movement can occur during thermal expansion or contraction of the casings.

The shape of the metal insert can ensure that forces imposed on it by the inner casing, which it supports, do not cause the metal insert to separate from the outer casing. In this way, a metal insert with greater hot strength can be provided that can overcome localised heating, and bond strength between the base material and the insert, without the need to cast the outer casing out of more expensive material that has a higher hot strength.

In this disclosure, the axial direction can be defined as the direction of the longitudinal axis of the steam turbine around which the rotor 10 of the steam turbine rotates. This longitudinal axis can provide further reference to other directional designations, such as the radial direction, which is perpendicular to the axis, and the circumferential direction, which is a direction that is concentric with the axis.

Further, within the general meaning of "encase", in this disclosure "encase" can be taken to have the specific meaning that a first feature is encased by a second feature if the first feature is bound within a straight line drawn between any two surface points of the second feature that are in contact with the first feature.

FIG. 1*a* shows a cross sectional view of an exemplary steam turbine. The steam turbine has an outer casing 30 with a casting 35. The casing 30 forms an outer shell around an inner casing 20 while the inner casing 20 further encases a rotor 10. The casting 35, in an exemplary embodiment, is made of a material selected for its ability to be cast, for example, nodular cast iron. A characteristic of such material is that it can have a relatively low hot strength. While this makes it suitable for casting, it renders it unsuitable for exposure to high temperature as found in some locations of high temperature steam turbines.

The casting 35 includes support regions 5, which support the inner casing 20. The support regions 5 include a metal insert 40 that through surface interaction can provide, the support of the inner casing 20, and can prevent contact between the casting 35 and the inner casing 20. By preventing contact, possible overheating of the casting 35 can be prevented. To prevent thermal damage of the metal insert 40 as it contacts the inner casing, the metal insert 40 can be made of a material with a higher hot strength than the casting 35. In an exemplary embodiment, this material can be, for example, a selection of one of St460TS and St12T.

The metal insert 40 has a surface encased by the casting 35 so as to define an encased surface 41. As shown in FIG. 1*b* and in FIGS. 2 to 4, the encased surface 41 can include, relative to the radial outward direction ROD, an axially and/or circumferentially flaring portion 42. The flaring can retain the metal insert 40 in the casting 35.

Figure 2:
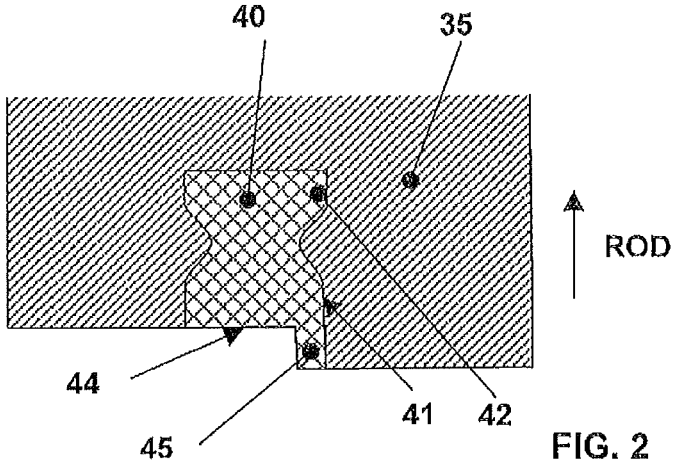
FIG. 2 is an expanded view of the support system of FIG. 1 showing an exemplary metal insert.
Figure 3:
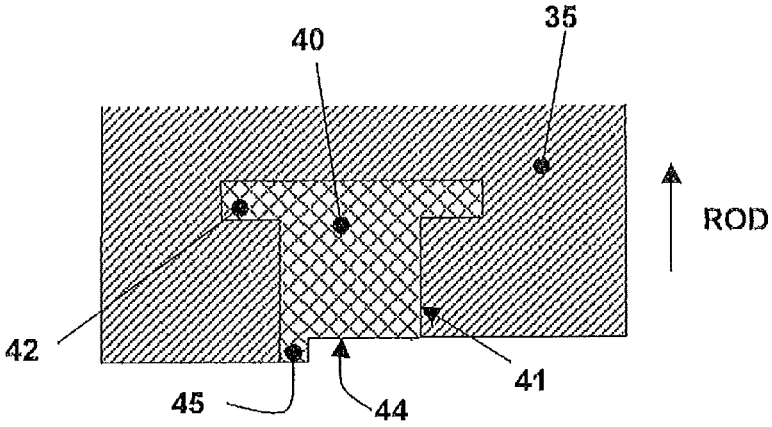
FIG. 3 is an expanded view of the support system of FIG. 1 showing another exemplary metal insert.
Figure 4:
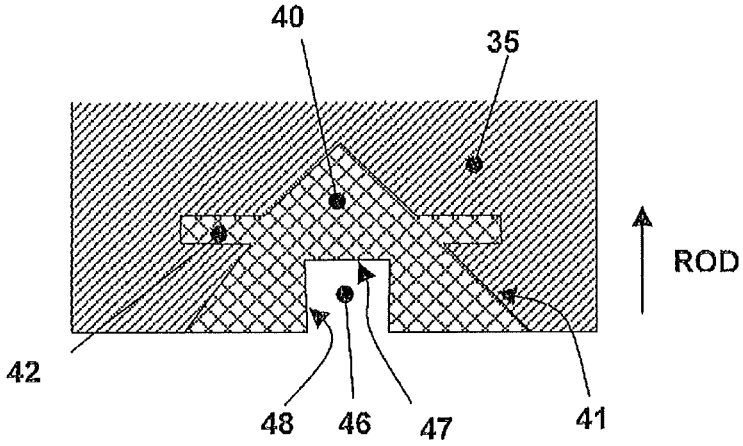
FIG. 4 is an expanded view of the support system of FIG. 1 showing yet another exemplary metal insert.
Figure 5:
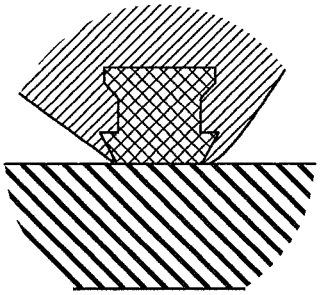
FIG. 5 is a cross-sectional view of a portion of FIG. 1 showing the flaring portion that flares axially.

FIGS. 2 to 4 show exemplary metal inserts 40 that have differently arranged flaring portions. FIG. 2, for example, shows an exemplary embodiment where the flaring portion 42 can be formed by the encased surface 41 having a waist region along its radial extension. FIG. 3 shows an exemplary embodiment where the flared portion 42 forms an axial and/or circumferential projection on the encased surface at a radially distal end of the metal insert 40. An embodiment shown in FIG. 3, FIG. 4 shows a flared portion 42 on the encased surface 41 that can be located part way along the radial extension of the encased surface 41, where the metal insert 40 can have a generally triangular shape. A metal insert 40 so shaped can be made suitable for use as a support region 5 by the flared portion 42.

Figure 1C:
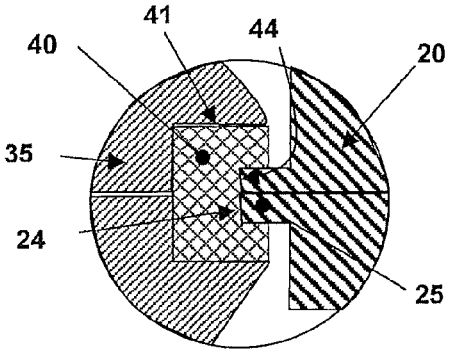
FIG. 1*b* and FIG. 1*c* are expanded views of portions of FIG. 1.
Figure 1B:
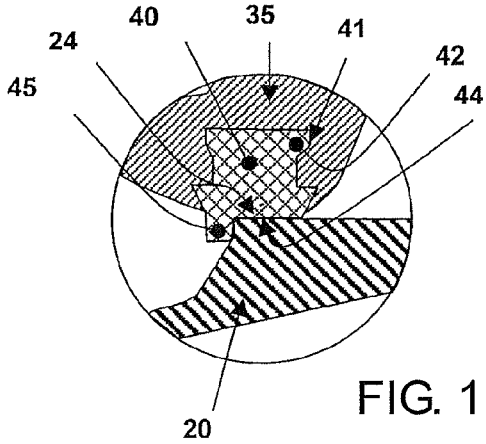

As shown in FIGS. 1*a* to 1*c*, the metal insert 40 can include a support surface 44 that is in contact with a contact surface 24 of the inner casing 20. This contact is the means by which the inner casing 20 supported by the outer casing 30. In conjunction with the contact surface 24, the support surface 44 can be configured to maintain a separation distance between the inner casing 20 and the casting 35 of the outer casing 30. This can ensure that the casting 35 is not overheated. "In conjunction" in this context means that the particular configuration of the support surface 44 considers the arrangement of the contact surface 24 in order to achieve the stated aim. As many contact surface 24 configurations and arrangements are possible, any one support surface 44 configuration is not universally applicable. Exemplary embodiments of some possible arrangements are shown in FIGS. 1*b* and 1*c*.

FIG. 1*b* shows an exemplary embodiment where both the contact surface 24 and the support surface 44 can be substantially flat. By the casting 35 radially receding from the metal insert 40 near the support surface 44, contact between the inner casing 20 and the casting 35 can be avoided.

FIG. 1*c* shows an exemplary embodiment where the support surface 44 can be a base 47 of a channel 46 formed in the metal insert 40. By means of the channel 46, the support surface 44 can be configured to receive a boss 25, which itself can be configured to be part of the contact surface 24 of the inner casing 20. A radial length of the contact surface boss 25, relative to a radial depth of the channel 46, can provide a means of maintaining the separation between the inner casing 20 and the casting 35. FIG. 4 also shows an exemplary embodiment with a similar channel 46 that can receive a contact surface boss 25.

As shown in each Figure, exemplary embodiments of the metal insert 40 also can include a guide that is adapted to guide the contact surface 24 over the support surface 44 while enabling relative movement of the inner casing 20 relative to the outer casing 30. Due to the typical temperature difference between the inner casing 20 and outer casing 30, it is important that the guiding means does not totally prevent relative movement. Otherwise differing thermal expansion rates can create additional stress in the casings. In addition, by limiting movement, the general position of the inner casing 20 relative to the outer casing 30 can be maintained.

FIG. 1*c* and FIG. 4 show exemplary embodiments where the guide is side-walls 48 of a channel 46 that guide a contact surface boss 25, as shown in FIG. 1*c*, received in the channel 46. In an exemplary embodiment, limited movement can be enabled by the channel 46 having an axial extension. This can enable a received contact surface boss 25 to move in a limited way, within the channel 46, in the axial direction.

FIGS. 1*b*, 2 and 3 each show exemplary embodiments where the guide means is a boss 45 that forms a radially inward extending portion of the metal insert 40. As shown in FIG. 1*b*, in compliment with a corner edge formed in the inner casing 20, the guide of these exemplary embodiments can limit one of the directional movement vectors of the contact surface 24 over the support surface 44.

Such exemplary guides can result in the application of additional lateral loads to the metal insert 40 thus resulting in the application of a radial inward vector load component on the metal insert 40. To prevent or at least reduce the risk of the metal insert 40 detaching from the casting 35 as a result of these loads, exemplary metal inserts 40 that have a guide can include exemplary flaring portions 42 as herein described and shown in the Figures.

Although the disclosure has been herein shown and described in what is conceived to be the most practical exemplary embodiments, it will be appreciated by those of ordinary skill in the art that the disclosure can be embodied in other specific forms. The presently disclosed embodiments are therefore considered in all respects to be illustrative and not restricted. The scope of the invention is indicated by the appended claims rather that the foregoing description and all changes that come within the meaning and range and equivalences thereof are intended to be embraced therein.

What is claimed is:

1. A steam turbine casing system, comprising:

an outer casing having a casting made of a first material and having a support region; and an inner casing, enclosed by the outer casing, for enclosing a rotor, the inner casing including a contact surface in contact with the support region, wherein the support region comprises:

a metal insert, made of a second material with a greater hot strength than the first material, that has an encased surface encased in the casting, wherein the encased surface includes, relative to a radial outward direction (ROD), an encased flaring portion that flares at least one of axially and circumferentially:

a support surface, in contact with the contact surface, configured in conjunction with the contact surface to maintain a separation between the inner casing and the casting; and a guide for guiding the contact surface over the support surface.

2. The steam turbine casing system of claim 1, wherein the contact surface comprises:

a boss.

3. The steam turbine casing system of claim 2, wherein the metal insert comprises:

two side walls that form the guide and a channel, adapted to receive the contact surface boss, the contact surface boss including a base as the support surface.

4. The steam turbine casing system of claim 3, wherein the channel extends in an axial direction to enable axial movement of the contact surface boss when received in the channel.

5. The steam turbine casing system of claim 4, wherein a radial length of the contact surface boss, relative to a radial depth of the channel is a means for maintaining separation between the inner casing and the casting.

6. The steam turbine casing system of claim 4, wherein the first material is nodular cast iron.

7. The steam turbine casing system of claim 4, wherein the second material is one of St460TS or St12T.

8. The steam turbine casing system of claim 3, wherein a radial length of the contact surface boss, relative to a radial depth of the channel is a means for maintaining separation between the inner casing and the casting.

9. The steam turbine casing system of claim 8, wherein the first material is nodular cast iron.

10. The steam turbine casing system of claim 2, wherein the first material is nodular cast iron.

11. The steam turbine casing system of claim 3, wherein the first material is nodular cast iron.

12. The steam turbine casing system of claim 3, wherein the second material is one of St460TS or St12T.

13. The steam turbine casing system of claim 8, wherein the second material is one of St460TS or St12T.

14. The steam turbine casing system of claim 2, wherein the second material is one of St460TS or St12T.

15. The steam turbine system of claim 1, wherein the guide is a radially inward extending boss.

16. The steam turbine casing system of claim 15, wherein the first material is nodular cast iron.

17. The steam turbine casing system of claim 15, wherein the second material is one of St460TS or St12T.

18. The steam turbine casing system of claim 1, wherein the first material is nodular cast iron.

19. The steam turbine casing system of claim 18, wherein the second material is one of St460TS or St12T.

20. The steam turbine casing system of claim 1, wherein the second material is one of St460TS or St12T.

* * * * *